US008746269B2

(12) United States Patent
Beeby et al.

(10) Patent No.: US 8,746,269 B2
(45) Date of Patent: Jun. 10, 2014

(54) METHOD FOR CONTROLLING A GAS FLOW BETWEEN A PLURALITY OF GAS STREAMS

(75) Inventors: Clive Beeby, Bangalore (IN); Willem Hupkes, Amsterdam (NL); Arina Petronella Jacoba Hupkes-van der Toorn, legal representative, Amsterdam (NL)

(73) Assignee: Shell Oil Company, Houston, TX (US)

( * ) Notice: Subject to any disclaimer, the term of this patent is extended or adjusted under 35 U.S.C. 154(b) by 611 days.

(21) Appl. No.: 13/058,705

(22) PCT Filed: Aug. 12, 2009

(86) PCT No.: PCT/EP2009/060432
§ 371 (c)(1),
(2), (4) Date: Jul. 5, 2011

(87) PCT Pub. No.: WO2010/018191
PCT Pub. Date: Feb. 18, 2010

(65) Prior Publication Data

US 2011/0253225 A1 Oct. 20, 2011

(30) Foreign Application Priority Data

Aug. 13, 2008 (EP) ..... 08162305

(51) Int. Cl.
*G05D 11/02* (2006.01)

(52) U.S. Cl.
USPC ..... 137/9; 137/12; 137/100; 137/101.19

(58) Field of Classification Search
USPC ..... 137/2, 9, 12, 98, 100, 101, 101.19, 110, 137/487.5
See application file for complete search history.

(56) References Cited

U.S. PATENT DOCUMENTS

| | | | | |
|---|---|---|---|---|
| 4,023,587 | A | 5/1977 | Dobritz | 137/88 |
| 6,662,817 | B2 * | 12/2003 | Yamagishi et al. | 137/9 |
| 7,007,707 | B2 * | 3/2006 | Ambrosina et al. | 137/9 |
| 2005/0005994 | A1 * | 1/2005 | Sugiyama et al. | 141/4 |
| 2006/0272703 | A1 * | 12/2006 | Lull et al. | 137/9 |
| 2007/0151988 | A1 | 7/2007 | Saucedo et al. | 222/389 |
| 2007/0295924 | A1 * | 12/2007 | Clausen | 251/129.04 |

FOREIGN PATENT DOCUMENTS

JP 1122961 A 1/1999

OTHER PUBLICATIONS

Machine translation of JP 1122961.*

* cited by examiner

*Primary Examiner* — John Fox
*Assistant Examiner* — Kevin Murphy

(57) ABSTRACT

The present invention relates to a method and apparatus for controlling a gas flow through a conjunction between one or more incoming streams and one or more outgoing streams through a conjunction. The method uses a biased mass flow imbalance value obtained by comparing the aggregate of incoming mass flow measurement value(s) with the aggregate of outgoing mass flow measurement value(s) and adding a bias component to provide the biased mass flow imbalance value. The flow of at least one of the incoming and outgoing streams (12, 14, 16, 18, 20) is adjusted to move the biased mass flow imbalance value towards zero. In addition, a conjunction pressure measurement (PC) is provided, which is used to adjust the bias component in response to a change in the conjunction pressure measurement (PC) relative to a pressure set point (PSP), to mitigate the change in the conjunction pressure measurement (PC) relative to the pressure set point (PSP).

16 Claims, 3 Drawing Sheets

METHOD FOR CONTROLLING A GAS FLOW BETWEEN A PLURALITY OF GAS STREAMS

The present application claims priority from European Patent Application 08162305.0 filed 13 Aug. 2008.

The present invention relates to a method and apparatus for controlling a gas flow through a conjunction between one or more incoming streams and one or more outgoing streams, particularly but not exclusively where the gas flow is steam or a hydrocarbon stream.

BACKGROUND OF THE INVENTION

In any arrangement where there are a number of providers of a gaseous stream, and a number of users such as consumers of the gaseous stream, there are systems for controlling the incoming and outgoing flows between the providers and the users, often through a collective header.

In a publication by Honeywell Prague Laboratory, of Honeywell s.r.o, Prague, entitled "Honeywell Unified Energy Solutions Portfolio Reduces Operational Costs and Maximises Profit of Power and Heat Production", there is described a conventional steam production control arrangement having a "Master Pressure Controller (MPC) on top of a cascade of steam production control. It maintains the header pressure in required operational range at varying steam demand, providing the control output—total heat input—for coordinated control of boilers.

However, a problem with this method of control is that the MPC can only take action once the header pressure has changed. The header pressure works as an integrator, so action by the MPC can only be relatively slow and mainly proportional.

SUMMARY OF THE INVENTION

The present invention provides a method for controlling the gas flow between one or more incoming streams and one or more outgoing streams through a conjunction comprising at least the steps of:

(a) determining the mass flow of at least one incoming stream to provide one or more respective incoming mass flow measurement value(s);

(b) determining the mass flow of at least one outgoing stream to provide one or more respective outgoing mass flow measurement value(s);

(c) providing a biased mass flow imbalance value by comparing the aggregate of all the incoming mass flow measurement value(s) of step (a) with the aggregate of all the outgoing mass flow measurement value(s) of step (b) and adding a bias component to provide the biased mass flow imbalance value;

(d) measuring quantity indicative of the gas pressure at the conjunction (22) to provide a conjunction pressure measurement (PC);

(e) adjusting the flow of at least one of the incoming and outgoing streams (12,14,16,18,20) to move the biased mass flow imbalance value towards zero; and (f) adjusting the bias component of the biased mass flow value in response to a change in the conjunction pressure measurement (PC) relative to a pressure set point (PSP) to mitigate the change in the conjunction pressure measurement (PC) relative to the pressure set point (PSP).

In a preferred embodiment, steps (a) to (f) are repeated a plurality of times, more preferably steps (a) to (f) are repeated to maintain the biased mass flow imbalance value at zero and provide a constant conjunction pressure measurement.

The present invention also provides an apparatus for controlling the gas flow between one or more incoming streams and one or more outgoing streams through a conjunction at least comprising:

one or more incoming flow measurers each able to provide one of one or more respective incoming mass flow measurement value(s) representing the flow of the one of the respective incoming streams;

one or more outgoing flow measurers each able to provide one of one or more respective mass outgoing flow measurement value(s) representing the flow of the one of the respective outgoing stream;

one or more pressure measurers able to measure a quantity indicative of the pressure of gas at the conjunction to provide a conjunction pressure measurement;

one or more flow adjusters to adjust the flow of at least one of the incoming and outgoing streams;

a controller to: provide a biased mass flow imbalance value by comparing the aggregate of the incoming mass flow measurement values(s) of the incoming flow measurers with the aggregate of the outgoing mass flow measurement values(s) of the outgoing flow measurers and adding a bias component to provide the biased mass flow imbalance value; receive the conjunction pressure measurement; instruct the one or more flow adjusters to adjust the flow of at least one of the incoming and outgoing streams to move the biased mass flow imbalance value towards zero; and adjust the bias component of the biased mass flow imbalance value in response to a change in the conjunction pressure measurement (PC) relative to a pressure set point (PSP) to mitigate the change in the conjunction pressure measurement (PC) relative to the pressure set point (PSP).

BRIEF DESCRIPTION OF THE DRAWINGS

Embodiments and examples of the present invention will now be described by way of example only and with reference to the accompanying non-limited drawings in which.

BRIEF DESCRIPTION OF THE INVENTION

Figure 1:
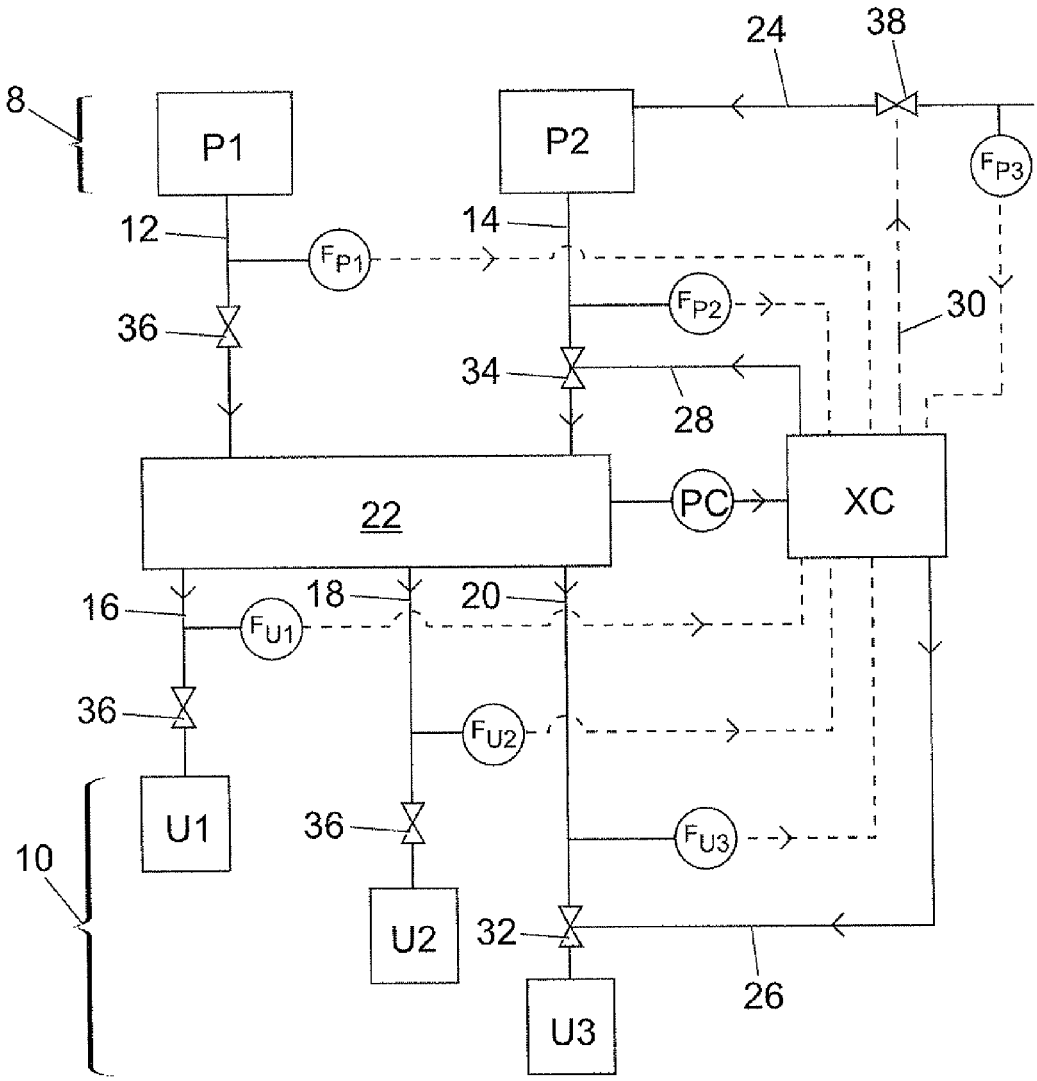
FIG. 1 is a first diagrammatic scheme for a system of controlling according to at least one embodiment disclosed herein.

For the purpose of this description, a single reference number will be assigned to a line as well as a stream carried in that line, and a single reference will be assigned to a pressure/flow of a stream as well as to a measurer of that pressure/flow.

The presently disclosed method provides more accurate control of the gas flow between one or more incoming streams, generally from one or more gaseous stream providers, and one or more outgoing streams, generally to one or more gaseous stream users, through a conjunction, based on comparing the aggregate or total of the flows of all the incoming streams (or a subset thereof) with the aggregate of the flows of all the outgoing streams (or a subset thereof). It is well known in the art how to determine mass flow from the measurement of the flow of a stream or from an estimate of the flow of a stream, such that a mass flow measurement value can be determined for each incoming and outgoing stream.

Changes in flow occur faster than changes in pressure measurements, and therefore quicker feedback can be obtained by monitoring any changes in a mass flow than by monitoring pressure changes, thereby allowing faster adjustment to compensate for a flow change. This way, the goal of attempting to provide a constant mass flow is easier to achieve and maintain.

The measurement of a constant pressure, for instance at the conjunction, provides a more accurate indicator that mass balance has been achieved. Thus, by measuring the flows of the incoming and outgoing streams together with the pressure at the conjunction, it is possible to quickly and accurately determine whether the mass flow between the total incoming and total outgoing streams at the conjunction is equal.

The determination of whether the mass flow between all the incoming and all the outgoing streams is balanced is carried out by comparing the aggregate of all the incoming and the aggregate of all the outgoing mass flow measurement values for the streams at the conjunction to provide a mass flow imbalance value.

For instance, the mass flow imbalance value can be calculated by subtracting the total of the mass flow measurement value(s) from all the outgoing streams from the conjunction from the total of the mass flow measurement value(s) from all the incoming streams at the conjunction. In this embodiment, a positive mass flow imbalance value will arise when the aggregate mass flow measurements of all the incoming streams exceeds the aggregate mass flow measurements of all the outgoing streams. Similarly, a negative mass flow imbalance value will arise when the aggregate mass flow measurements of all the incoming streams is less than the aggregate mass flow measurements of all the outgoing streams at the conjunction. When the aggregate incoming and aggregate outgoing mass flow measurement values for all the streams are equal, the mass flow imbalance value will be zero.

A further variable, the bias component, is added to the mass flow imbalance value to provide a biased mass flow imbalance value. The bias component compensates for inaccuracies in the mass flow measurement values. For instance, a mass flow measurement value can be interpreted as the combination of the actual mass flow value and a measurement error. The bias component takes account of these measurement errors and includes these in the biased mass flow imbalance value. The bias component is dependent upon the properties of the particular system in which the present method and apparatus are used, such as the type and number of flow measurers, gas composition(s) etc. The bias component can initially be calculated under balanced mass flow conditions at the conjunction when the conjunction pressure measurement is constant.

The bias component is adjusted in response to changes in the conjunction pressure measurement relative to a conjunction pressure set point to mitigate theses pressure changes or to accommodate a new pressure set point. The set point can be user defined set point input for a particular system. For instance, the change in the conjunction pressure measurement relative to the conjunction pressure set point can be calculated by subtracting the conjunction pressure measurement from the conjunction pressure set point.

The conjunction pressure measurement changes when the mass of gas in the conjunction changes. The mass of gas in the conjunction will change when the aggregate mass flow of all the incoming streams and the aggregate mass flow of all the outgoing streams are different. A change in the conjunction pressure measurement is therefore an indicator of a mass flow imbalance at the conjunction.

Thus, pressure measurement is a more accurate way of determining mass flow imbalance at the conjunction compared to the determination of mass flow measurement values from stream flows because, all other things being equal, a change in conjunction pressure is directly proportional to a change in the mass of gas in the conjunction.

The bias component added to the mass flow imbalance value is adjusted in response to the change in the conjunction pressure measurement relative to the pressure set point, to mitigate changes in the conjunction pressure or allow the system to evolve to a new set point. Thus the biased mass flow imbalance value may change even if the mass flow imbalance value is zero, the latter indicating a balance in the measured incoming and outgoing mass flow measurement values. This may occur in the situation where the flow measurements suggest there is mass flow balance at the conjunction, but due to errors in the measurements this is not the case. By altering the value of the bias component in response to the change in the conjunction pressure measurement, the biased mass flow imbalance value is changed. The flow of at least one of the incoming or outgoing streams will be adjusted in response to the change in the biased mass flow imbalance value. In this way, changes in the conjunction pressure measurement can affect the flow of one or more of the incoming and outgoing streams and therefore increase the accuracy of the determination.

For instance, for a fixed conjunction pressure set point, if the conjunction pressure is increasing, this means that the mass flow of gas into the conjunction exceeds the mass flow of gas out of the conjunction. The bias component is therefore adjusted to alter the biased mass flow imbalance value so that the flow rate of one or more incoming streams is decreased, and/or the flow rate of one or more outgoing streams is increased to mitigate this conjunction pressure change. In a similar manner, if the conjunction pressure is decreasing, the bias component is adjusted to alter the biased mass flow imbalance value so that the flow rate of an incoming stream is increased, and/or the flow rate of an outgoing stream is decreased to mitigate this conjunction pressure change.

Thus, where there is a mass flow imbalance at the conjunction, the biased mass flow imbalance value will be non-zero because the conjunction pressure measurement and therefore bias component will be changing, optionally together with the mass flow imbalance value. The non-zero biased mass flow imbalance value will result in the adjustment of the flow of at least one of the incoming and outgoing streams to the conjunction to move the biased mass flow imbalance value towards zero, in order to reduce the mass flow imbalance at the conjunction. These steps can be repeated until the biased mass flow imbalance value is zero, indicating that mass flow balance at the conjunction has been achieved. Any further change in the flow of one or more of the incoming and outgoing streams may result in a new mass flow imbalance at the conjunction, leading to a change in the aggregate incoming and outgoing flows, and a subsequent change in the conjunction pressure measurement, resulting in a non-zero biased mass flow imbalance value. The method and apparatus disclosed herein will then function to restore the mass balance at the conjunction.

It will be understood by the person skilled in the art that a conjunction pressure measurement does not require an actual measurement of pressure of the gas at the conjunction—it may be any type of measurement of any quantity that is indicative of the pressure in the conjunction, such as for instance the pressure of the gas in a branch that is in pressure communication with the conjunction.

Likewise, it will be understood that it is not necessary to provide a separate number for the mass flow imbalance, such as described above. A value for the biased mass flow imbalance should be sufficient because the flow adjustments are primarily controlled to move the biased mass flow imbalance value towards zero.

Moreover, it will be understood by the person skilled in the art that it is not necessary to measure the flows. A determination of the flows can also be made using an estimate. As an example, one way of estimating the flow from a producer is when the producer is operating at a known, such as full, half or zero, capacity, then the flow can be determined by estimating using the specification or experience values for the specific producer.

Moreover, it will be understood by the person skilled in the art that it is not necessary to determine the flow of each of the incoming streams or outgoing streams. It could suffice to determine, for instance, only the ones that can change enough to cause a problem. The unmeasured flows become part of the bias component. Thus, the control methods and apparatus described herein could be implemented by determining only a subset of the incoming stream flows and none of the outgoing stream flows, or vice versa, or both. However, it may offer an advantage of more flexibility if indeed each incoming flow and/or outgoing flow is determined.

FIG. 1:

FIG. 1 shows a system for controlling the gas flow between two incoming streams 12, 14 and three outgoing streams 16, 18, 20 through a conjunction 22. The present invention is not limited by the number of incoming streams and outgoing streams, or by the relative ratio or numbers of incoming and outgoing streams.

For the present invention, the conjunction may be any suitable intercommunication, union, inter-location, space or area of combination between the one or more incoming streams and the one or more outgoing streams. One example of a conjunction is a manifold or header, being a location, which may be greater than the cross-sections of the lines carrying the one or more incoming streams and the one or more outgoing streams, able to provide a volume for the collection of the one or more incoming streams and their subsequent division or distribution into the one or more outgoing streams.

Optionally, the conjunction may also provide a volume or location able to temporarily hold or store a volume of the gas between its incoming flow(s) and outgoing flow(s).

Further optionally, the conjunction allows at least some mixing of two or more incoming streams prior to the provision of the or each outgoing stream.

The conjunction may also be a connection or union between one incoming stream and one outgoing stream, one incoming stream and at least two outgoing streams, or at least two incoming streams and one outgoing stream. Such conjunctions include a length of a pipeline, or a T-piece or other simple stream-union or stream-divider known in the art.

The present invention is not limited by the size, nature, design or type of the conjunction.

The gas of the incoming stream(s) and outgoing stream(s) may be any gas able to flow along a line, including substances which are only gaseous in a super critical phase, and gases comprising one or more minor amounts of other phases, such as gas/liquid combinations.

In one embodiment, the gas of the or each incoming stream is one or more selected from the group comprising: steam, fuel gas, one or more hydrocarbons, nitrogen and hydrogen. The one or more hydrocarbons include methane, ethane, propane, butanes, pentanes and heavier hydrocarbons, and any combination thereof.

One example is natural gas, obtainable from a natural gas or petroleum reservoir. As an alternative, the natural gas stream may also be obtained form another source, also including a synthetic source such as a Fischer-Tropsch process.

The or each incoming stream may be provided by one or more gaseous stream providers, generally labeled "8" in FIG. 1. Two or more incoming streams may be provided by the same gaseous stream provider, either directly or indirectly. Two or more incoming streams may provide the same gas, but at different physical conditions such as temperature and pressure, and/or different molar or component proportions, and/or different properties (such as heating value for fuel gas). The conjunction of such streams allows at least some equalization of such differences to occur prior to the provision of the outgoing streams.

Examples of gaseous stream providers include one or more selected from the group comprising: boilers, (waste) heat recovery units and hydrocarbon processing units such as crude gas and crude oil processors.

For example, where the incoming stream is steam, this can be provided directly from a boiler. Steam can also be provided directly from a heat recovery unit which is recovering waste heat from any suitable apparatus, unit or device producing waste heat energy such as a turbine. A hydrocarbon processing unit being a gas provider may provide one or more hydrocarbons, such as fuel gas, as an incoming stream.

The present invention is not limited by the nature of the gas provider(s), many of which are known in the art.

The or each outgoing stream may be provided to one or more gaseous stream users, generally labeled "10" in FIG. 1. Examples of gaseous stream users include one or more selected from the group comprising: boilers, turbines and export gas.

For example, a suitable user of an outgoing stream being steam is a steam turbine. A suitable user of an outgoing stream being fuel gas is a boiler. A suitable user of an outgoing stream being methane, generally with a defined specification, may be an export gas line, gas supply line or gas distribution network, generally herein defined as "export gas".

FIG. 1 shows a first incoming stream 12 provided from a first provider P1, and a second incoming stream 14 provided by a second provider P2. The first and second incoming streams 12, 14 provide gas flows to a conjunction 22, such as a header or manifold 22 known in the art. From the conjunction 22, there is provided a first outgoing stream 16 to a first user U1, a second outgoing stream 18 to a second user U2, and a third outgoing stream 20 to a third user U3. Preferably, there is at least some equalization of the nature of the first and second incoming streams 12, 14 if they are different (such as in composition, flow and/or physical parameters) prior to the provision of the first, second and third outgoing streams 16, 18, 20.

By way of example only, where the first and second gaseous stream providers P1 and P2 are waste heat recovery units and the gas provided therefrom is steam, the conjunction can then organize the equal or non-equal distribution of the steam to first, second and third steam turbines as the users U1, U2 and U3. Non-equal distribution may be based on one or more gaseous stream users 10 requiring a different volume flow thereto.

The present invention comprises measuring the flow of each incoming stream 12, 14 to provide respective incoming mass flow measurements. The monitoring of stream flow allows the determination of mass flow. Mass flow is proportional to stream flow and can be calculated from stream flow by methods known in the art. The flow measurement of a stream of a gas can be carried out by any suitable apparatus, unit or device, such as a flow measurer known in the art. Non-limiting examples of flow measurers include orifice plates, venturi tubes, flow nozzles, variable area meters, pilot tubes, calorimetric meters, turbine meters, coriolis meters, ultrasonic Doppler meters and vortex meters.

FIG. 1 shows a first flow measurer $F_{P1}$ measuring the flow of the first incoming stream 12 to provide a first incoming mass flow measurement $F_{P1}$ which can be provided to a controller XC. Similarly, FIG. 1 shows a second flow measurer $F_{P2}$ measuring the flow of the second incoming stream 14 to provide a second incoming mass flow measurement $F_{P2}$ to the controller XC.

Similarly, FIG. 1 also shows three outgoing flow measurers $F_{U1}$, $F_{U2}$ and $F_{U3}$ for measuring the flow of the three outgoing streams 16, 18, 20 to provide three respective outgoing mass flow measurements which are also provided to the controller XC. FIG. 1 shows the five flow measurements being passed along dashed signal paths to the controller XC.

The controller XC is able to aggregate the incoming mass flow measurements from all the incoming streams 12, 14, aggregate the outgoing mass flow measurements from all the outgoing streams 16, 18, 20, and to compare these measurements to provide a mass flow imbalance value at the conjunction 22.

The conjunction pressure measurement PC is provided to the controller XC. A conjunction pressure set point PSP is also input into the controller SC. The pressure set point PSP can be input by the operator. The controller XC can then calculate a change in the conjunction pressure measurement PC relative to the pressure set point PSP.

For the present invention, a mass flow imbalance value is the difference between the two aggregates, for instance the aggregate of the incoming mass flow minus the aggregate of the outgoing mass flow.

Use of a conjunction pressure measurement advantageously provides the ability to calculate the change in pressure of the gas in the conjunction 22 over time. Measurement of the pressure of the gas at the conjunction 22, especially over time, allows the user to perceive change in gas mass in the conjunction 22, and accommodate any change in the conjunction pressure particularly relative to a conjunction pressure set point with an adjustment of the flow of one or more of the incoming and outgoing streams. This is done by adding the bias component to the mass flow imbalance value to provide the biased mass flow imbalance value. When the conjunction pressure measurement changes relative to the conjunction pressure measurement set point, the bias component is adjusted to mitigate the pressure change or to allow the system to evolve to another conjunction pressure set point. Adjusting the bias component changes the biased mass flow imbalance value. When the biased mass flow imbalance value is non-zero, the flow of at least one of the incoming and outgoing streams will be adjusted in order to move the biased mass flow imbalance value towards zero. While changes in the conjunction pressure measurement (PC) occur more slowly than changes in the flow rate, pressure measurement is a more accurate way of measuring mass flow imbalance.

When a constant conjunction pressure measurement is observed, mass balance between the aggregate incoming and aggregate outgoing streams has been achieved i.e. the biased mass flow imbalance value is zero. Thus, there is no requirement to determine the absolute value of the pressure at the conjunction 22, only whether or not this pressure is changing.

Thus, a change in the conjunction pressure measurement PC relative to the conjunction pressure set point PSP will lead to a change in the bias component, which in turn will lead to a change in the biased mass flow imbalance value. This will result in a change in the flow of at least one of the streams 12, 14, 16, 18, 20 if the biased mass flow imbalance value is non-zero, as the controller XC moves the biased mass flow imbalance value towards zero.

Provided the conjunction pressure set point PSP is not changed, a constant conjunction pressure measurement PC will not lead to a change in the bias component and the biased mass flow imbalance value will remain unchanged. When the biased mass flow imbalance value is zero, the controller XC will determine that the system is in a balanced state or balanced condition, such that no adjustment of the flow of any of the incoming streams and outgoing streams is required.

Any errors in the determination of the stream flows (whether by measurement or estimate) can result in errors in the incoming and/or outgoing mass flow measurement values, such that the mass flow measurement values may not correspond to the actual mass flows. For instance, a mass flow measurement value may be interpreted as a combination of the actual mass flow measurement value together with an associated measurement error. The bias component compensates for such errors in the mass flow measurement values. Thus, a balanced state can occur even when the mass flow imbalance value is non-zero, because the bias component can take account of any measurement errors and adjust the biased mass flow imbalance value to produce a zero value.

A situation may also occur in which the mass flow imbalance value is zero, indicating measured mass flow balance because the aggregate of all the incoming mass flow measurement values is equal to all the outgoing mass flow measurement values, but the conjunction pressure measurement PC relative to a pressure set point PSP is changing over time. For a constant pressure set point PSP, this is indicative of a situation where the mass of gas at the conjunction is not constant such that actual mass balance has not been achieved between the incoming streams 12, 14 and the outgoing streams 14, 16, 18 at the conjunction 22. The changing conjunction pressure measurement PC relative to the constant pressure set point PSP will result in an adjustment in the value of the bias component in order to mitigate the pressure change. The biased mass flow imbalance value will therefore be non-zero leading to the adjustment in the flow of at least one of the streams 12, 14, 16, 18, 20 until mass balance, as indicated by a constant conjunction pressure measurement PC is achieved.

When the pressure set point PSP is changed, the conjunction pressure measurement relative to the pressure set point i.e. the difference between the pressure set point and the conjunction pressure measurement will change, giving rise to an adjustment in the bias component. This change in the bias component will lead to the adjustment in the flow of at least one of the incoming and outgoing streams, moving the system to the new conjunction pressure set point.

For instance, if the conjunction pressure set point is increased, the bias component will be adjusted in response to the change, e.g. the increase, in the difference between the new conjunction pressure set point PSP and the conjunction pressure measurement PC. The adjusted bias component will result in a change in the biased mass flow imbalance value, leading to one or both of an increase in the mass flow of one or more of the incoming streams and a decrease in the mass flow of one or more of the outgoing streams in order to move the biased mass flow imbalance value towards zero, thereby moving the system towards the new, higher conjunction pressure set point.

Similarly, if the conjunction pressure set point is decreased, the bias component will be adjusted in response to the change, e.g. the decrease, even to a negative value, in the difference between the new conjunction pressure set point PSP and the conjunction pressure measurement PC. The adjusted bias component will result in a change in the biased mass flow imbalance value, leading to one or both of an decrease in the mass flow of one or more of the incoming streams and a increase in the mass flow of one or more of the outgoing streams in order to move the biased mass flow imbalance value towards zero, thereby moving the system towards the new, lower conjunction pressure set point.

In one embodiment, it is an objective to maintain the conjunction pressure measurement at a constant value over a period of time, preferably at least 30 seconds, more preferably at least 30 minutes, even more preferably at least 12 hours, and even more preferably at least 3 days. This is possible when the pressure set point PSP is constant.

FIG. 1 shows two non-limiting examples of adjustment of one of the incoming streams and/or one of the outgoing streams. In a first example, the controller XC is adapted to adjust the flow of the third outgoing stream 20 via operation along signal line 26 of a suitable flow control mechanism such as a first valve 32 in the third outgoing stream line 20.

In a second example, the controller XC is able to adjust the flow of the second incoming stream 14 via operation along signal line 28 of a suitable control mechanism such as a second valve 34 in said line 14.

In one embodiment, adjustment to reduce the biased mass flow imbalance value may be carried out on only one outgoing stream, preferably an outgoing stream whose flow is more easily able to be varied and/or adjusted compared to the flow of other outgoing streams.

For example, a gaseous stream user such as a turbine may require a minimum gas flow to operate normally, such that its gas flow should not be varied below such a minimum, or should be maintained within a certain range to maintain constant operation of the turbine. Adjustment of the flow of steam or fuel gas along an outgoing stream to such a turbine may not be preferable, compared to for example adjustment of the flow of methane to export gas.

A method is provided which can seek to reduce to zero the aggregate of all the incoming mass flows minus the aggregate of all the outgoing mass flows from a conjunction 22 and the bias component, by taking account of variation in the conjunction pressure measurement PC relative to the pressure set point PSP, the aggregate of one or more incoming gas flow streams 12, 14 and/or aggregate of one or more outgoing gas flow streams 16, 18, 20.

Variation in gas flows may occur for many reasons, usually due to variation in the operation of one or more of the gaseous stream providers 8 and/or gaseous stream users 10. An example is a heat recovery unit, whose provision of a gas flow of steam may vary according to the amount of heat created by the apparatus, unit or device associated with the heat recovery unit. Another example is the provision of a hydrocarbon stream such as natural gas from one or more reservoirs, wells or wellheads.

It is advantageous that by measuring the flow of the or each incoming stream and the flow of the or each outgoing stream, rapid, almost instant, control can be taken to balance the gas flows through the conjunction 22. This provides a method of balancing the mass of gas flow through the conjunction 22, which can then also provide a method of balancing the production of the or each gas provider, and the consumption by the or each gas user.

As well as controlling minor variations in the changes in gas flow of one or more of the incoming streams and/or outgoing streams, the rapid accommodation of significant variations or changes in the gas flow of one or more of the incoming streams and/or outgoing streams is also possible.

For example, where a boiler 'trips' or otherwise rapidly declines or ceases to operate, or has another significant operational deficiency, there may be a rapid decline in the gas flow of, for example, the first incoming stream 12. This can be immediately noticed by a change in the incoming flow measurement for the incoming stream 12 from the first flow measurer $F_{P1}$, and the controller XC can immediately adjust one or more flows of the or each outgoing stream to move towards zero the biased flow imbalance value created in the conjunction 22 by the drop in the first incoming stream 12 flow.

Similarly, one or more of the outgoing streams 16, 18, 20 may require to be wholly to substantially reduced and/or halted, and their flow measurement(s) therefore affect the aggregate of the outgoing flow measurements. To reduce the biased flow imbalance value towards zero, the controller XC can immediately adjust the flow of the or each other outgoing stream, and/or one or more of the incoming streams.

The skilled man is aware of variations possible in adjusting the flows of one or more of the incoming streams and/or one or more of the outgoing streams. FIG. 1 shows a flow adjusting means 32, 34, 36 such as a valve on each of the incoming streams 12, 14, and on each of the outgoing streams 16, 18, 20, to allow separate and/or co-coordinated or related adjustment of the flow of each of the incoming streams and the outgoing streams by the controller XC.

The pressure at the conjunction 22 is also measured and affects the calculation of the adjustment of the flow of at least one of the incoming and outgoing streams 12, 14, 16, 18, 20 to reduce to the biased mass flow imbalance value towards zero. FIG. 1 shows measuring the gas pressure at conjunction 22 by a pressure measurer PC, to provide a conjunction pressure measurement, which can be provided to the controller XC.

Use of a conjunction pressure measurement advantageously provides the ability to calculate the change in pressure of the gas in the conjunction 22 over time, and, for a constant pressure set point, to use changes in the conjunction pressure measurement to adjust the bias component to mitigate the pressure changes. Adjusting the bias component can change the biased mass flow imbalance value which can lead to an alteration of the flow of one or more of the incoming and outgoing streams over time in conjunction with the usually more rapid adjustment based on changes in the flow measurements as described above.

Most if not all gases have the ability to be easily compressed when at a low pressure, especially in a larger volume, which can increase the gas mass within such a volume without impacting, at least significantly, the flow of gas either incoming from one or more incoming streams, or outgoing to one or more outgoing streams. For a constant pressure set point, measurement of the pressure of the gas at the conjunction 22, especially over time, allows the user to perceive change in gas mass in the conjunction 22, and accommodate any change in the conjunction pressure with an adjustment of the flow of one or more of the incoming and outgoing streams by changing the bias component of the biased mass flow imbalance value.

Thus, the method used herein is able to look at adjustment in the flow of one or more incoming and outgoing streams 12, 14, 16, 18, 20 based both on rapid flow measurements, and on usually slower pressure measurements over time, to provide a significantly more accurate mass balance of gas flow through the conjunction 22. When a constant conjunction pressure measurement is observed, mass gas balance between the aggregate incoming and aggregate outgoing streams has been achieved i.e. the biased mass flow imbalance value is zero.

For example, where a gas provider 8 becomes unavailable, its share of the gas load required by the gaseous stream users 10 can be immediately taken up by the remaining gas provider (s) 8. This may be the full load of that particular gaseous stream provider 8, or an incremental load if the gaseous stream provider 10 has been taken out of cascade. Such control is carried out on the basis of individual flow measurements and flow control, which is inherently faster and therefore more accurate than just total pressure measurement and total pressure control.

Using pressure measurement in addition to individual flow control provides a feed-back mechanism to assist the accuracy of the flow model and control of the method used herein.

The flow measurement devices such as $F_{P1}$ provide direct measurement of the gas flow of at least one of the incoming streams 12, 14. The gas flow can then be used to calculate mass flow, and aggregated over all the incoming streams to provide an incoming mass flow measurement value.

Additionally and/or alternatively, it is possible to measure the flow of one or more of the incoming streams from a gas provider 8 by measurement of the flow of a fluid to the gas provider 8.

For example, where the gas provider P2 is a boiler, measurement of the flow of fuel along a fuel line 24 to the gas provider P2 can be made by a suitable fuel flow measurer $F_{P3}$. The flow measurement is able to provide a relative measurement to the controller XC which can be used to determine or predict the equivalent gas flow from the gas provider P2 (for example based on its heat value), and thus to predict or determine the expected gas mass flow measurement along the second incoming line 14 that will result from the provider P2 based on calculation of the flow of fuel through the fuel line 24.

FIG. 1 shows a further embodiment wherein the controller XC can adjust the flow of the fuel line 24 by a signal through a signal line 30 to a suitable valve 38, which adjustment in the flow of fuel will adjust the relative flow of the second incoming stream 14 from the gas provider P2, thereby providing a system for controlling the gas flow of the second incoming stream 14 by indirect adjustment of the flow of an incoming stream.

This can be particularly advantageous where, for example, the tripping of a steam boiler can, in some circumstances, create a short term increase in measured steam production therefrom prior to ceasing. This increase would provide a flow measurement which is seen as increasing, (whereas measurement of fuel into the boiler will show a forthcoming decrease in gas flow). This occurs because the lower pressure in the steam drum of a steam boiler results in increased steam production over the short term, whilst the steam drum is returning to equilibrium. Using flow measurement of the incoming stream from the steam boiler could therefore provide an over-estimation of the incoming stream, which could then provide an unwanted adjustment of one or more of the other incoming and/or outgoing streams. Thus, it can be beneficial to additionally and/or alternatively measure the flow of fluid stream into the steam boiler (which would indicate a drop in the fuel gas being provided, and therefore a soon-to-be drop in steam flow along an incoming line to the conjunction 22), as the correct flow measurement, understanding of which must then be taken by the controller XC.

FIG. 1 shows various embodiments able to control the mass balance of the flow of a gas from one or more incoming streams through a conjunction to one or more outgoing streams.

Figure 2:
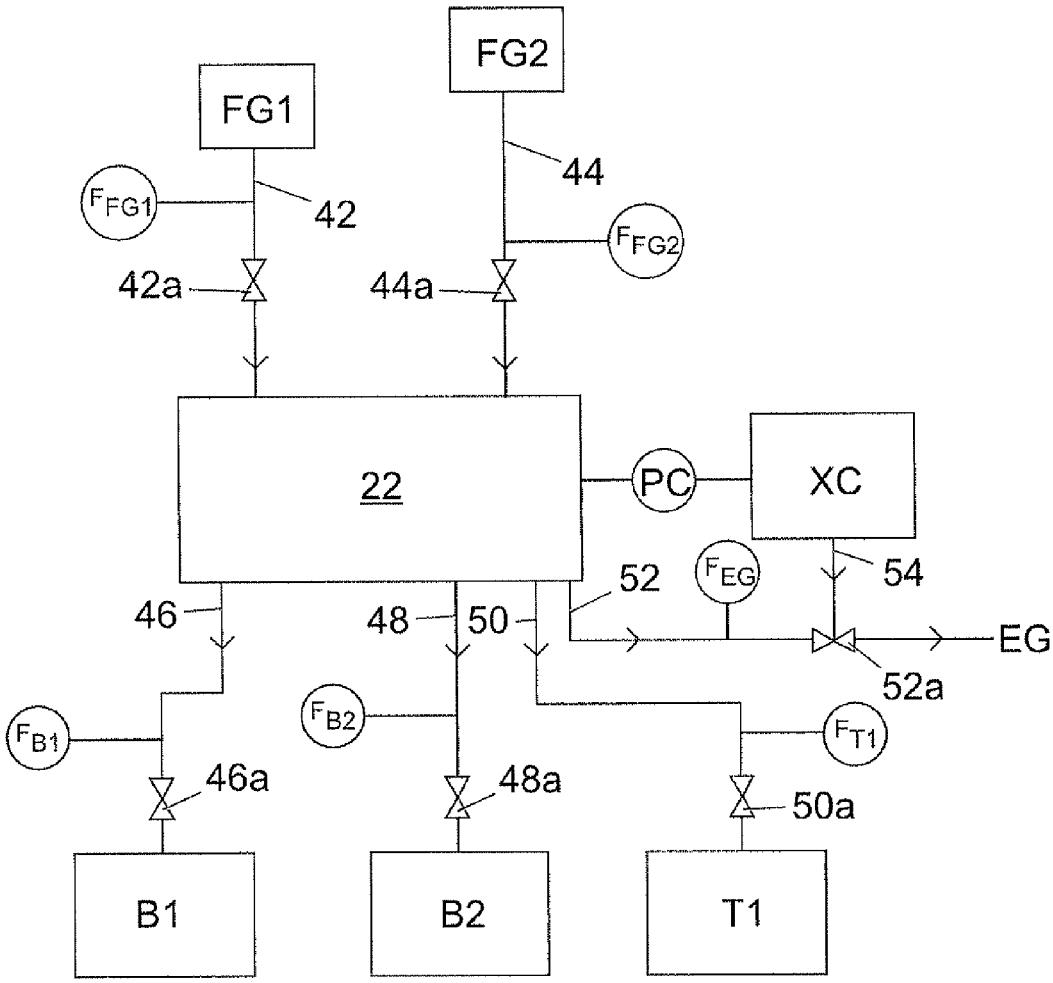
FIG. 2 is a second diagrammatic scheme for a system of controlling according to a second embodiment disclosed herein.

FIG. 2:

FIG. 2 shows various arrangements for a system for controlling gas flow according to a second embodiment.

In FIG. 2, a first gaseous stream provider FG1 provides a first incoming stream 42 of a fuel gas such as methane, whose flow can be measured by a first flow measurer $F_{FG1}$ and whose flow can be controlled by a first valve 42*a*.

FIG. 2 shows a second gaseous stream provider FG2 being a second source of fuel gas FG2 along a second incoming stream 44 whose flow can be controlled by a second valve 44*a*, and whose flow can be measured by a second flow measurer $F_{FG2}$.

The incoming streams 42, 44 collect in a conjunction 22 such as a fuel gas manifold known in the art, to provide fuel gas to three outgoing streams 46, 48, 50, which pass the fuel gas to, for example, a first boiler B1, a second boiler B2 and a first gas turbine T1 respectively. The conjunction 22 also provides fuel gas to a fourth outgoing stream 52 to provide export gas, labeled in FIG. 2 as "EG".

FIG. 2 shows flow measurers $F_{FG1}$, $F_{FG2}$, $F_{B1}$, $F_{B2}$, $F_{T1}$ and $F_{EG}$, and respective valves 42*a*, 44*a*, 46*a*, 48*a*, 50*a* and 52*a*, on the respective incoming streams 42, 44 and outgoing streams, 46, 48, 50 and 52. The flow measurers provide flow measurements for each of the streams to the controller XC in a manner described hereinabove, (along signal lines not shown in FIG. 2 for clarity purposes only), and the controller XC is able to control each of the valves separately, or in a coordinated, integral and/or related manner.

FIG. 2 also shows a pressure measurer PC of the gas pressure in the conjunction 22, which can relay a pressure measurement to the controller XC. A pressure set point PCP can also be input to controller XC.

A particular feature of FIG. 2 is adjusting the flow of the export gas outgoing stream 52 to move the biased mass flow imbalance value in the conjunction 22 to zero. In this way, variation of the flows of fuel gas along the outgoing streams 46, 48 and 50 can be avoided, or at least minimized unless catastrophically required, so as to maintain as far as possible constant flow of fuel gas to the first and second boilers B1, B2, and to the first steam turbine T1, for a constant pressure set point PSP. The output from the first and second boilers B1 and B2, and from the first steam turbine T1, can therefore be maintained as far as possible, whilst any variation in the flows of the first incoming stream 42 and/or second incoming stream 44 of fuel gas can be accommodated by adjusting the flow of export gas EG, whose maintenance or regularity is not, at least in the present example, as demanding as the flow requirements to the first and second boilers B1, B2 and the first steam turbine T1.

Moreover, where the output of one or more of the first and second boilers B1, B2 and the first steam turbine T1 is reduced and/or halted, for example following a reduction in power demand downstream, rapid and easy accommodation of continuing gas flows from the first and second incoming streams 42, 44 can be provided by adjustment of the flow of the fourth outgoing stream 52 by operation of its valve 52*a* through a signal line 54 from the controller XC.

Thus, it is a further advantage that the method and apparatus disclosed herein provides flexibility in any variation in the gas flow through a mass balance in a conjunction, irrespective of the nature of the gas and the rate of change or variation in the gas flow along one or more of the incoming and outgoing streams.

It is another advantage of the method and apparatus disclosed herein that variation in one or more of the incoming and/or outgoing streams can be based on desired or controlled variation in one or more of the gaseous stream providers and gaseous stream users. For example, where it is desired to carry out maintenance on one or more of the gaseous stream gaseous stream producers and/or gaseous stream users, variation in the gas flow through the conjunction 22 can be adjusted to take account of the absence and/or reduction of gas flow from or gas flow to one of the gaseous stream users and/or gaseous stream providers.

Similarly, where there is start-up of one more of the gaseous stream providers and gaseous stream users, the start-up of the flow of an incoming stream and/or the start-up of the flow to a gas user, can be accommodated by the adjustment of the other incoming and/or outgoing streams.

Operation and provision of measurements and signals between the flow measurers and the flow controllers such as valves, is known to the person skilled in the art, and may be carried out with or without a central controller such as the controller XC shown in FIGS. 1 and 2.

Figure 3:
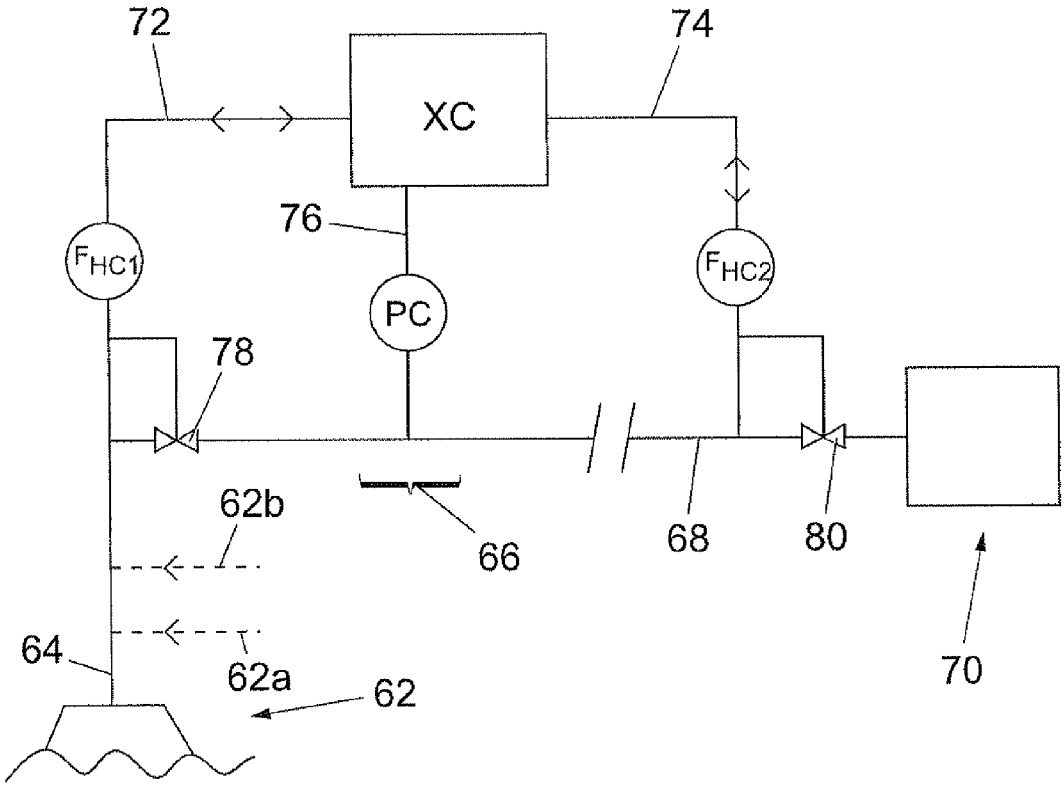
FIG. 3 is a third diagrammatic scheme for a system of controlling according to a third embodiment disclosed herein.

FIG. 3:

FIG. 3 shows a system for controlling gas flow according to a third embodiment.

In FIG. 3, a wellhead 62 is the source of a hydrocarbon stream such as natural gas, and this provides an incoming stream 64. The incoming stream 64 passes through a conjunction 66 which in the embodiment shown in FIG. 3 could be a length of the pipeline carrying the hydrocarbon stream between the wellhead 62 and a subsequent user of the hydrocarbon stream such as a hydrocarbon processing facility 70.

Suitable hydrocarbon processing facility 70 can include one or more treatment plants or units, usually intended to change the specification of the hydrocarbon stream. This can include one or more treatments of the hydrocarbon stream such as acid-gas removal in an Acid Gas Removal Unit (AGRU), the hydrocarbon stream being cooled, preferably liquefied, in for example a liquefied natural gas plant, and/or use of the hydrocarbon stream to provide a heavier product stream such as a gas-to-liquid plant.

The hydrocarbon processing facility 70 may be close to the wellhead 62, but is commonly some distance therefrom such that variation in the flow of the hydrocarbon stream 64 at or near the wellhead 62 may not be the same as variation in the gas flow at or near the hydrocarbon processing facility 70. The wellhead 62 and hydrocarbon processing facility 70 may be any on-shore/off-shore set up known in the art.

According to the present embodiment, the flow of the incoming stream 64 can be measured by a flow measurer $F_{HC1}$ at or near the wellhead 62, to provide a first flow measurement along a first signal line 72 to a controller XC. Meanwhile, the flow of the outgoing stream 68 at or near the hydrocarbon processing facility 70 can be measured by a second flow measurer $F_{HC2}$ which can provide a flow measurement to the controller XC along a second signal line 74. Further, the pressure of the hydrocarbon stream at the conjunction 66 can also be provided by a gas pressure measurer PC, to provide a conjunction pressure measurement along line 76. The conjunction pressure set point PSP can also be provided to the controller XC.

In the controller XC, there is comparison of the incoming flow measurement from $F_{HC1}$, with the outgoing flow measurement from the $F_{HC2}$, to provide a mass flow imbalance value between same. A bias component is added to the mass flow imbalance value to provide a biased mass flow imbalance value. The bias component is adjusted in response to changes in the conjunction pressure measurement PC relative to the pressure set point PSP in order to mitigate such pressure changes. Where the biased mass flow imbalance value is greater or less than zero, adjustment of the flow of the incoming stream 64, or outgoing stream 68 can be carried out by control of a first valve 78 in the line of the incoming stream 64, and/or a second valve 80 in the line of the outgoing stream 68, optionally via signals through the first and second flow measurers $F_{HC1}$, $F_{HC2}$, respectively.

The pressure measurement from the pressure measurer PC provides an indication of any change in pressure at the conjunction 66 along the pipeline carrying the hydrocarbon stream between the incoming stream 64 and the outgoing stream 68, which provides an indication of any trend in pressure change over time along the pipeline. When the pressure is changing over time, the biased mass flow imbalance value will also be changing because the bias component is adjusted in response to changes in the conjunction pressure measurement relative to the pressure set point PSP in order to mitigate these changes. This will alter the biased mass flow imbalance value. The flows of one or both of the incoming and outgoing streams can be adjusted in response to changes in biased mass flow imbalance value until a constant conjunction pressure measurement value indicating a balance of the actual aggregate flow of the incoming an outgoing streams is achieved.

Where the pipeline is long or very long, such as many kilometers long, any change in the conjunction pressure measurement can be an indicator of a gas leakage or seepage, or blockage, which may not be otherwise determinable where the flows of the incoming stream 64 and the outgoing stream 68 at their flow measurers $F_{HC1}$ and $F_{HC2}$ is seemingly constant or maintained.

Optionally, the incoming stream 64 may be joined with one or more other incoming streams 64*a* and 64*b* from one or more other wellheads or other hydrocarbon sources. All such incoming streams and/or sources could be provided as a single incoming stream prior to flow measurement, and/or be provided as multiple incoming streams each having their own flow measurement values.

In one implementation of the method and apparatus described hereinabove, a fixed estimate of the flow of some of the incoming streams was used rather than actual measured values, because the flow measurement available turned out not to be reliable. The estimate was to assume zero flow in case of the producer tripping, and maximum flow in case of the producer operating normally. Determining the incoming flow based on an estimate like this still provides most of the benefit when the equipment that is providing gas flow to the conjunction "trips". For example, it was estimated that a specific producer in the form of boiler "A" produces 80 tph of steam in normal operation and zero if it trips. If it trips, then controller XC may in response adjust the incoming flows from other producers to add 80 tph to the aggregate incoming flow. If boiler "A" were actually producing 91 tph at the time of the trip, this would mean that in its first response the controller would not have adjusted the flows to add quite enough to the other incoming streams, but only ~90% of what it should have been in order to balance the incoming and outgoing flows.

The pressure in the conjunction would then slowly decrease relative to its set point, causing the controller to adjust the bias value (leading to further adjustment of the flows as a result of the biased mass flow imbalance value moving away from zero due to the adjustment in the bias value) to mitigate the error introduced by the inaccuracy of the estimate.

The person skilled in the art will understand that the present invention can be carried out in many various ways without departing from the scope of the appended claims.

What is claimed is:

1. A method for controlling the gas flow between one or more incoming streams and one or more outgoing streams through a conjunction comprising:

(a) determining the mass flow of at least one of the incoming streams to provide one or more respective incoming mass flow measurement value(s);

(b) determining the mass flow of at least one of the outgoing streams to provide one or more respective outgoing mass flow measurement value(s);

(c) providing a biased mass flow imbalance value by comparing the aggregate of all the incoming mass flow measurement value(s) of step (a) with the aggregate of all the outgoing mass flow measurement value(s) of step (b) and adding a bias component to provide the biased mass flow imbalance value;

(d) measuring a quantity indicative of the gas pressure at the conjunction to provide a conjunction pressure measurement (PC);

(e) adjusting the flow of at least one of the incoming and outgoing streams to move the biased mass flow imbalance value towards zero; and (f) adjusting the bias component of the biased mass flow imbalance value in response to a change in the conjunction pressure measurement (PC) relative to a pressure set point (PSP) to mitigate the change in the conjunction pressure measurement (PC) relative to the pressure set point (PSP).

2. A method as claimed in claim 1 wherein the biased mass flow imbalance value is:

(Total of all incoming mass flow measurement values)−(Total of all outgoing mass flow measurement values)+bias component.

3. A method as claimed in claim 1, wherein each incoming stream is one or more selected from the group comprising: steam, fuel gas, one or more hydrocarbons, nitrogen and hydrogen.

4. A method as claimed in claim 1, comprising at least two incoming streams.

5. A method as claimed in claim 1, comprising at least two outgoing streams.

6. A method as claimed in claim 4 wherein the conjunction is a manifold.

7. A method as claimed in claim 1, wherein the incoming stream is provided by a respective gaseous stream provider, and the outgoing stream is provided to a gaseous stream user.

8. A method as claimed in claim 7 wherein the incoming stream is provided by a gaseous stream provider being one or more selected from the group consisting of: boilers, heat recovery units, hydrocarbon sources, and hydrocarbon processing units.

9. A method as claimed in claim 7 wherein the outgoing stream is provided to a gaseous stream user comprising one or more selected from the group consisting of: boilers, turbines, export gas and hydrocarbon processing units.

10. A method as claimed in claim 1 wherein determining the mass flow comprises direct measurement of at least one of the incoming streams.

11. A method as claimed in claim 1, wherein determining the mass flow comprises the indirect measurement of at least one of the incoming streams.

12. A method as claimed in claim 11 wherein determining the mass flow comprises the measurement of the flow of a fluid stream to at least one gaseous stream provider to provide measurement of the flow from the at least one incoming stream from the gaseous stream provider.

13. A method as claimed in claim 1 comprising direct adjustment of the flow of one outgoing stream.

14. A method as claimed in claim 1 comprising indirect adjustment of the flow of at least one incoming stream.

15. A method as claimed in claim 1 wherein an incoming stream is provided by a wellhead, and at least one outgoing stream is provided to a hydrocarbon processing facility.

16. Apparatus for controlling the gas flow between one or more incoming streams and one or more outgoing streams through a conjunction; comprising:

one or more incoming flow measurers each able to provide one or more respective incoming mass flow measurement values representing the flow of the one of the respective incoming streams;

one or more outgoing flow measurers each able to provide one or more respective mass outgoing flow measurement values representing the flow of the one of the respective outgoing stream;

one or more pressure measurers able to measure a quantity indicative of the pressure of gas at the conjunction to provide a conjunction pressure measurement;

one or more flow adjusters to adjust the flow of at least one of the incoming and outgoing streams;

a controller to provide a biased mass flow imbalance value by comparing the aggregate of the incoming mass flow measurement values of the incoming flow measurers with the aggregate of the outgoing mass flow measurement values of the outgoing flow measurers and adding a bias component to provide the biased mass flow imbalance value; receive the conjunction pressure measurement; instruct the one or more flow adjusters to adjust the flow of at least one of the incoming and outgoing streams to move the mass flow imbalance value towards zero; and adjust the bias component of the biased mass flow imbalance value in response to a change in the conjunction pressure measurement relative to a pressure set point to mitigate the change in the conjunction pressure measurement relative to the pressure set point.

* * * * *